US011487225B2

(12) United States Patent
Desai et al.

(10) Patent No.: US 11,487,225 B2
(45) Date of Patent: Nov. 1, 2022

(54) LIQUID ELECTROPHOTOGRAPHY PRINTING ON FABRICS

(71) Applicant: HP Indigo B.V., Amstelveen (NL)

(72) Inventors: Harsh Pranav Desai, San Diego, CA (US); Evgeny Korol, San Diego, CA (US); Avinoam Halpern, San Diego, CA (US)

(73) Assignee: HP Indigo B.V., Amstelveen (NL)

( * ) Notice: Subject to any disclaimer, the term of this patent is extended or adjusted under 35 U.S.C. 154(b) by 74 days.

(21) Appl. No.: 16/605,104

(22) PCT Filed: Oct. 13, 2017

(86) PCT No.: PCT/US2017/056519
§ 371 (c)(1),
(2) Date: Oct. 14, 2019

(87) PCT Pub. No.: WO2019/074519
PCT Pub. Date: Apr. 18, 2019

(65) Prior Publication Data

US 2021/0278782 A1 Sep. 9, 2021

(51) Int. Cl.

| | |
|---|---|
| ***G03G 15/10*** | (2006.01) |
| ***B41F 16/02*** | (2006.01) |
| ***B41F 17/00*** | (2006.01) |
| ***B41F 17/38*** | (2006.01) |
| ***G03G 9/125*** | (2006.01) |
| ***G03G 15/00*** | (2006.01) |

(52) U.S. Cl.
CPC ..... *G03G 15/104* (2013.01); *B41F 16/02* (2013.01); *B41F 17/003* (2013.01); *B41F 17/38* (2013.01); *G03G 9/125* (2013.01); *G03G 15/6591* (2013.01); *G03G 2215/00527* (2013.01); *G03G 2215/1685* (2013.01)

(58) Field of Classification Search
CPC ..... B41F 16/02; B41F 17/003; B41F 1/38; B41F 17/38; G03G 15/104; G03G 15/6591; G03G 2215/00527; G03G 15/1665; G03G 2215/1685
See application file for complete search history.

(56) References Cited

U.S. PATENT DOCUMENTS 5,689,761 A 11/1997 Denton
5,905,925 A * 5/1999 Kawabata ..... G03G 15/502 399/45

(Continued)

FOREIGN PATENT DOCUMENTS

CN 101348633 A 1/2009
EP 0672965 9/1995

(Continued)

OTHER PUBLICATIONS

Chevli, S., Selecting the Right Ink and Fabric Combination for Digital Printing, Jan. 1, 2007.

*Primary Examiner* — Erika J. Villaluna
(74) *Attorney, Agent, or Firm* — Fabian VanCott

(57) ABSTRACT

A liquid electrophotographic (LEP) printing device that includes a photo-imaging plate (PIP) to receive a liquid printing fluid, the liquid printing fluid including a pigment incorporated into a resin, a charge conductor, and a carrier liquid, and a transfer roller to transfer the liquid printing fluid from the PIP to a fabric substrate while wet.

17 Claims, 4 Drawing Sheets

(56) References Cited

U.S. PATENT DOCUMENTS

| | | | |
|---|---|---|---|
| 6,785,501 | B2 | 8/2004 | Hongawa et al. |
| 2002/0159801 | A1 | 10/2002 | Nakashima et al. |
| 2006/0045572 | A1 | 3/2006 | Hongawa et al. |
| 2009/0207198 | A1 | 8/2009 | Muraoka |
| 2015/0268589 | A1 | 9/2015 | Nedelin et al. |
| 2015/0316868 | A1 | 11/2015 | Granapthiappan et al. |
| 2017/0021638 | A1 | 1/2017 | Barndt |
| 2017/0218564 | A1 | 8/2017 | Sloan |

FOREIGN PATENT DOCUMENTS

| | | | | | |
|---|---|---|---|---|---|
| JP | 52-056615 | A | | 5/1977 | |
| JP | 05297746 | | | 11/1993 | |
| JP | 07311503 | A | | 11/1995 | |
| JP | 2001060046 | | | 3/2001 | |
| JP | 2002311725 | | | 10/2002 | |
| JP | 2004333633 | | | 11/2004 | |
| JP | 2006243143 | | | 9/2006 | |
| JP | 2007139986 | | | 6/2007 | |
| JP | 2008508563 | | | 3/2008 | |
| JP | 2008090116 | A | * | 4/2008 | |
| JP | 2008139900 | | | 6/2008 | |
| JP | 2008233397 | | | 10/2008 | |
| JP | 2009086347 | | | 4/2009 | |
| JP | 2017187739 | A | * | 10/2017 | ..... G03G 15/04036 |
| KR | 2015-0035732 | | | 4/2015 | |
| WO | WO-2013132424 | | | 9/2013 | |
| WO | WO2016048343 | A1 | | 3/2016 | |
| WO | WO-2016101987 | A1 | * | 6/2016 | ..... C09C 1/043 |

* cited by examiner

LIQUID ELECTROPHOTOGRAPHY PRINTING ON FABRICS

BACKGROUND

Liquid electrophotography printing (LEP) apparatus includes a number of binary ink developers that provide printing fluid such as liquid toner to fluid applicators. The fluid applicators provide charged liquid toner to a latent image on a photoconductive member to form fluid images. The photoconductive member transfers the fluid images onto an image transfer member and/or substrate.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1:
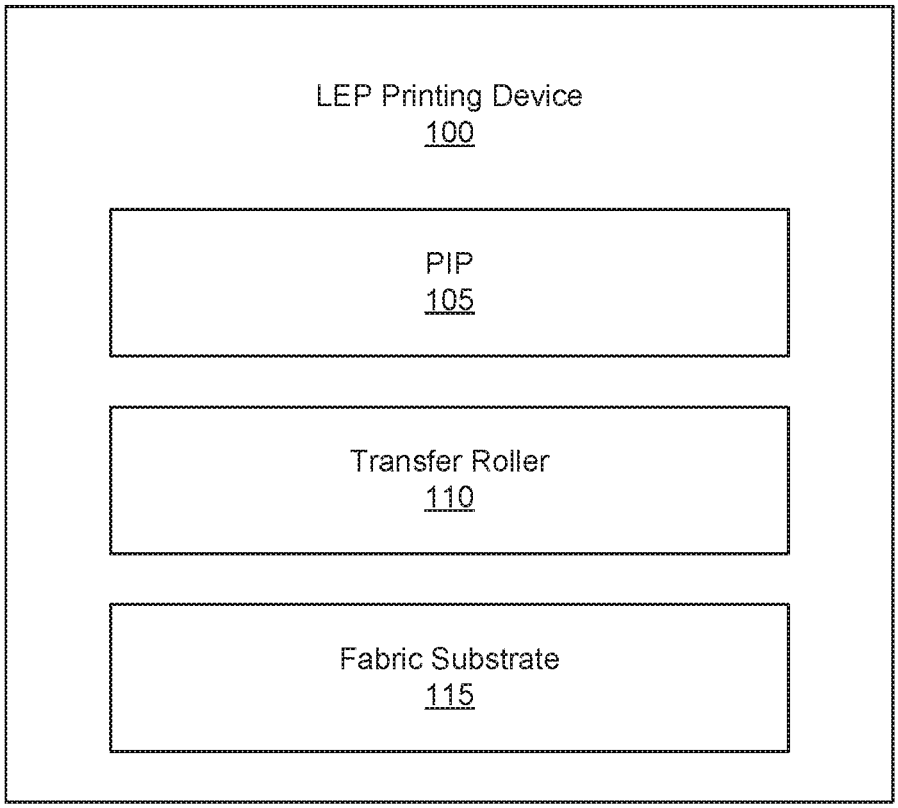
FIG. 1 is a block diagram of a liquid electrophotographic (LEP) printing device according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description: however, the description is not limited to the examples and/or implementations provided in the drawings.

DETAILED DESCRIPTION

As described above, LEP printing devices implement a number of printing fluid developers that transfer an amount of printing fluid to a charged photoconductive plate. The charged photoconductive plate may transfer the printing fluid to a transfer roller which, with the aid of an impression roller, transfers the printing fluid to print substrate.

The print substrate in the example above is paper. During operation of the LEP, the transfer roller is heated to a temperature ranging from 100° to 150° Celsius. This causes evaporation of a carrier fluid such as and isoparaffinic hydrocarbon from the printing fluid thereby allowing the printing fluid to be smeared or otherwise pressed onto the paper. Because the carrier fluid with the printing fluid is evaporated, the printing fluid becomes tacky and may be easily transferred onto the paper.

This process, however, cannot be used to print onto a textile. Instead, as the printing fluid is pressed onto the fabric, the tackiness of the printing fluid will not allow the printing fluid to penetrate into the fibers of the textile. Without absorption into the fibers of the textile, the printing fluid is left to cure on the outer surface of the textile leading to cracking, peeling, and flacking of the printing fluid from off of the textile.

The present specification describes a liquid electrophotographic (LEP) printing device that includes a photo-imaging plate (PIP) to receive a liquid printing fluid, the liquid printing fluid including a pigment incorporated into a resin, a charge conductor, and a carrier liquid, and a transfer roller to transfer the liquid printing fluid from the PIP to a fabric substrate while wet.

The present specification also describes a system for printing onto fabric, the system including a printing fluid source comprising a printing fluid, the printing fluid comprising, at least, a carrier fluid and a heat adjustable transfer roller to receive an amount of printing fluid from a photo imaging plate and transfer the printing fluid to the fabric while the carrier fluid is still present in the printing fluid.

The present specification further describes a transfer roller that includes a heating device wherein the transfer roller to receive an amount of printing fluid from a photo-imaging plate (PIP) and transfer the printing fluid to a fabric while preventing the evaporation of a carrier fluid within the printing fluid.

As used in the present specification and in the appended claims, the term "wet printing fluid" is meant to be understood as a printing fluid that has a level of carrier fluid therein such that it may be absorbed into fibers of a fabric.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language means that a particular feature, structure, or characteristic described in connection with that example is included as described, but may or may not be included in other examples.

Turning now to the figures, FIG. 1 is a block diagram of a liquid electrophotographic (LEP) printing device (100) according to an example of the principles described herein. The LEP printing device (100) may include, at least, a photo-imaging plate (PIP) (105) to receive a liquid printing fluid and a transfer roller (110) to transfer the liquid fluid from the PIP (105) to a fabric substrate (115).

The LEP printing device (100) may further include, in addition to the PIP (105) and transfer roller (110), a number of printing fluid developers. a charging device to form a latent image on the PIP (105), and an impression roller. During operation, a source of printing fluid is provided to the number of printing fluid developers. The printing fluid developers provide the printing fluid to the surface of the PIP (105). The PIP (105) is previously charged with the charging device to form a latent image on the PIP (105). Because the printing fluid includes a number of charged particles, the charged portions formed on the PIP (105) attract the charged particles thereto thereby changing the latent image to a printing fluid image on the PIP (105). This may occur for each printing fluid developer that may include different colors as part of the image formed onto the PIP (105), The PIP (105) may transfer the created image on the PIP (105) to the transfer roller (110), The transfer roller (110) then, with the aid of the impression roller transfer the printing fluid forming the image onto a substrate.

During operation, the transfer roller (110) is heated in order to print the image onto a paper substrate. In this case, the transfer roller (110) is heated to temperatures ranging from 100° to 150° Celsius. This is done so as to evaporate the carrier liquid such as an isoparaffinic hydrocarbon. This method works for paper because the evaporation of the carrier liquid causes the printing fluid to become tacky and stick to the surface of a relatively cooler substrate such as the paper. However, this method will not work for fabric substrates (115). Instead, without the carrier fluid, the tacky printing fluid is left to be laid on top of the fabric. As the fabric is used or otherwise handled, the printing fluid may flake or peel off causing distortion of the image and dissatisfaction of the printed product.

In order to correct this, the transfer roller (110) is not heated to 100° to 150° Celsius but instead merely heated to between 70° and 95° Celsius. In this example, the carrier fluid or at least a significant portion of the carrier fluid is left to be applied to the fabric relatively wetter. The relatively wetter printing fluid may penetrate into the fibers of the fabric thereby enabling direct textile printing on sheet-feed & web-feed LEP printing device (100). In an example, 0 to 10 percent of the carrier fluid is evaporated on the transfer roller (110) before transfer of the printing fluid to the fabric or other textile substrate. In some examples, the amount of carrier fluid in the printing fluid may be altered based on the characteristics of the fabric such as the porousness of the fabric, the type of material of the fabric, and the absorbability of the fabric, among other characteristics.

In an example, the LEP printing device (100) may adjust the temperature of the transfer roller (110) based on the type of substrate to be printed on. Therefore, a user may interface with the LEP printing device (100) such that the user may indicate a type of print substrate (i.e., general types of paper substrate, specific types of paper substrate, general types of fabric substrate (115), and/or specific types of fabric substrate (115)) to be printed on, and the temperature of the transfer roller (110) may be automatically set to accommodate that type of print substrate. In the case of a fabric substrate (115), the LEP printing device (100) may further allow a user to select different types of fabric substrates (115) to be printed on so that the amount of carrier fluid not evaporated by a heated transfer roller (110) may be adjusted in order to create an optimal image within the fabric substrate (115).

The LEP printing device (100), in an example, may include other peripheral devices and devices. In an example, the LEP printing device (100) may include, at least a processor to receive data describing a print job and execute the print job. In an example, the LEP printing device (100) may include a data storage device to, at least, maintain data describing a print job as well as other computer usable program code to be executed by the processor in order to enact the functoriality of the LEP printing device (100) described herein.

In an example, the LEP printing device (100) may be communicatively coupled to a computing device that, at least, provides and maintains a number of print jobs to be executed by the LEP printing device (100). Examples of electronic devices include servers, desktop computers, laptop computers, personal digital assistants (PDAs), mobile devices, smartphones, gaming systems, and tablets, among other electronic devices.

The LEP printing device (100) may be utilized in any data processing scenario including, stand-alone hardware, mobile applications, through a computing network, or combinations thereof. Further, the LEP printing device (100) may be used in a computing network, a public cloud network, a private cloud network, a hybrid cloud network, other forms of networks, or combinations thereof. In one example, the methods provided by the LEP printing device (100) are provided as a service over a network by, for example, a third party. In this example, the service may comprise, for example, an over-network printing service.

To achieve its desired functionality, the LEP printing device (100) and/or computing device associated with the LEP printing device (100) includes various hardware components. Among these hardware components may be a number of processors, a number of data storage devices, a number of peripheral device adapters, and a number of network adapters. These hardware components may be interconnected through the use of a number of busses and/or network connections. In one example, the processor, data storage device, peripheral device adapters, and a network adapter may be communicatively coupled via a bus.

The processor may include the hardware architecture to retrieve executable code from the data storage device and execute the executable code. The executable code may, when executed by the processor, cause the processor to implement at least the functionality of directing the LEP printing device (100) to print onto a fabric substrate (115) using the predefined temperatures for the transfer roller (110), according to the methods of the present specification described herein. In the course of executing code, the processor may receive input from and provide output to a number of the remaining hardware units.

The data storage devices placed either within the LEP printing device (100) or a computing device communicatively coupled to the LEP printing device (100) may store data such as executable program code that is executed by the processor or other processing device. The data storage device may specifically store computer code representing a number of applications that the processor executes to implement at least the functionality described herein.

The data storage devices may include various types of memory modules, including volatile and nonvolatile memory. For example, the data storage device of the present example includes Random Access Memory (RAM), Read Only Memory (ROM), and Hard Disk Drive (HDD) memory. Many other types of memory may also be utilized, and the present specification contemplates the use of many varying type(s) of memory in the data storage device as may suit a particular application of the principles described herein. In certain examples, different types of memory in the data storage device may be used for different data storage needs. For example, in certain examples the processor may boot from Read Only Memory (ROM), maintain nonvolatile storage in the Hard Disk Drive (HDD) memory, and execute program code stored in Random Access Memory (RAM).

Generally, the data storage device may comprise a computer readable medium, a computer readable storage medium, or a non-transitory computer readable medium, among others. For example, the data storage device may be, but not limited to, an electronic, magnetic, optical, electromagnetic, infrared, or semiconductor system, apparatus, or device, or any suitable combination of the foregoing. More specific examples of the computer readable storage medium may include, for example, the following: an electrical connection having a number of wires, a portable computer diskette, a hard disk, a random-access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a computer readable storage medium may be any tangible medium that can contain, or store computer usable program code for use by or in connection with an instruction execution system, apparatus, or device. In another example, a computer readable storage medium may be any non-transitory medium that can contain, or store a program for use by or in connection with an instruction execution system, apparatus, or device.

The hardware adapters in the LEP printing device (100) and/or the computing device communicatively coupled to the LEP printing device (100) enable the processor to interface with various other hardware elements, external and internal to the LEP printing device (100) and/or the computing device communicatively coupled to the LEP printing device (100). For example, the peripheral device adapters may provide an interface to input/output devices, such as, for example, display device, a mouse, or a keyboard. The peripheral device adapters may also provide access to other external devices such as an external storage device, a number of network devices such as, for example, servers, switches, and routers, client devices, other types of computing devices, and combinations thereof.

The display device may be provided to allow a user of the LEP printing device (100) to interact with and implement the functionality of printing onto a fabric substrate (115). The peripheral device adapters may also create an interface between the processor and the display device, a printer, or other substrate output devices. The network adapter may provide an interface to other computing devices within, for example, a network, thereby enabling the transmission of data between the LEP printing device (100) and other devices located within the network.

The LEP printing device (100) may, itself, include a display device. The display device when executed by the processor, display the number of graphical user interfaces (GUIs) on the display device associated with the executable program code representing the number of applications stored on the data storage device. The GUIs may display, for example, printing options such as substrate selection for printing. Additionally, via making a number of interactive gestures on the GUIs of the display device, a user may select printing options or preferences and have the LEP printing device (100) print onto the fabric substrate (115) according to those selected options or preferences. Examples of display devices include a computer screen, a laptop screen, a mobile device screen, a personal digital assistant (FDA) screen, and a tablet screen, among other display devices.

In an example, the LEP printing device (100) may further include at least one accumulator that accumulates an amount of printed fabric substrate (115). The accumulator may include a heating and/or other drying device that heats and/or dries the printed fabric substrate (115) before it is accumulated within the accumulator. An example of a heating and/or drying device may include an infrared emissive device, an electromagnetic heat source, a heat lamp, an air knife, among other printing fluid drying or heating devices. The accumulator may be placed between two separate LEP printing device (100) in order to accumulate an amount of fabric substrate (115) therein before reversing the printable side of the fabric substrate (115) and sending it to the second of the two LEP printing device (100).

In an example, the transfer roller (110) may heat the printing fluid to a temperature of between 70° and 95° Celsius. In an example, the transfer roller (110) may heat the printing fluid to a temperature of 95° Celsius. In these examples, any type of heating device may be used in connection with the transfer roller (110), In an example, the heating device may be inside the transfer roller (110), outside the transfer roller (110), or a combination thereof. However, as described herein, because the LEP printing device (100) is printing onto a fabric substrate (115), the temperature may be reduced.

Figure 2:
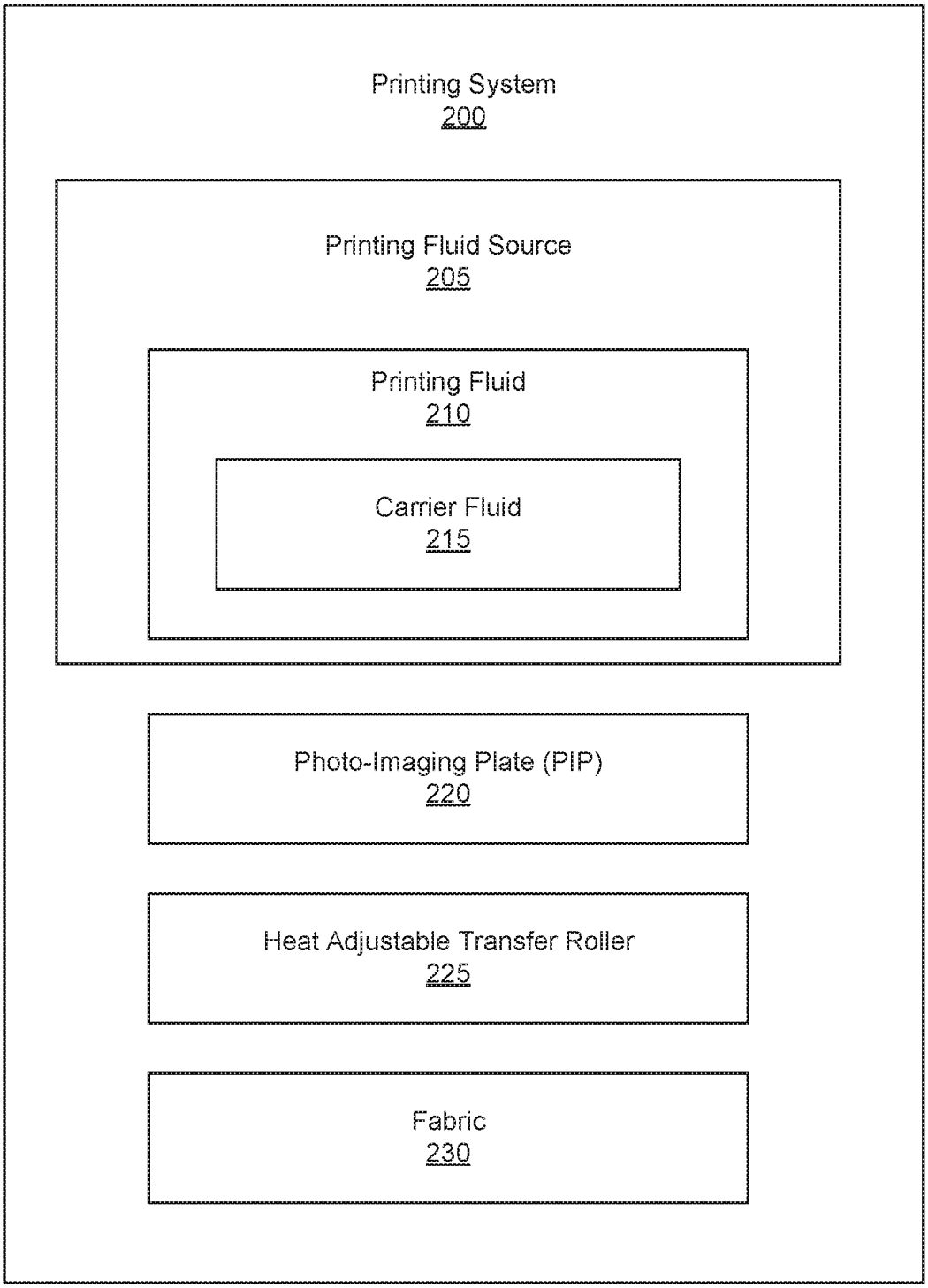
FIG. 2 is a block diagram of a system for printing onto fabric according to an example of the principles described herein.

FIG. 2 is a block diagram of a system (200) for printing onto fabric (230) according to an example of the principles described herein. The system (200) may include a printing fluid source (205) that includes a printing fluid (210), the printing fluid (210) including, at least, a carrier fluid (215), and a heat adjustable transfer roller (225) to receive an amount of printing fluid (210) from a photo imaging plate PIP (220) and transfer the printing fluid (210) to the fabric (230) while the carrier fluid (215) is still present in the printing fluid (210). AS described above, the system (200) may, in some examples, further include a number of printing fluid developers and other rollers that facilitate the movement of the fabric (230) through the system (200) as well as interact with other rollers such as the heat adjustable transfer roller (225) and PIP (220).

Again, in an example, the system (200) may further include an accumulator used to accumulate an amount of fabric therein. In an example, the accumulator further includes a heat source to heat the fabric as it is wet from the printing process conducted by the system (200), Indeed, because the heat adjustable transfer roller (225) is heated to a temperature of around 70° to 95° Celsius, almost all of the carrier fluid (215) remains in the printing fluid (210) as it is applied to the fabric (230). The heating device within the accumulator dries the carrier fluid (215) within the printing fluid (210) allowing the remaining portions of the printing fluid (210) to remain imbedded within the fibers of the fabric (230). Again, the accumulator may also include a number of rollers that turn the fabric (230) to the other side for printing on a system (200) downstream of the accumulator.

The printing fluid (210) described herein may include a number of different components, one of which is the carrier fluid (215) described herein. In some examples, the printing fluid (210) may further include a pigment incorporated into a resin and a charge conductor. The printing fluid (210) is printed to the fabric (230) wet with the carrier fluid (215) remaining therein and allowing, at least, the pigment incorporated into the resin to seep into the fibers of the fabric (230). When the printing fluid (210) is dried by the heat source in the accumulator, the carrier fluid (215) is evaporate away leaving, at least, the pigment and resin embedded into the fibers of the fabric (230). As a result, the image defined by the printing process described herein will not flake or peel off from the fabric (230).

Figure 3:
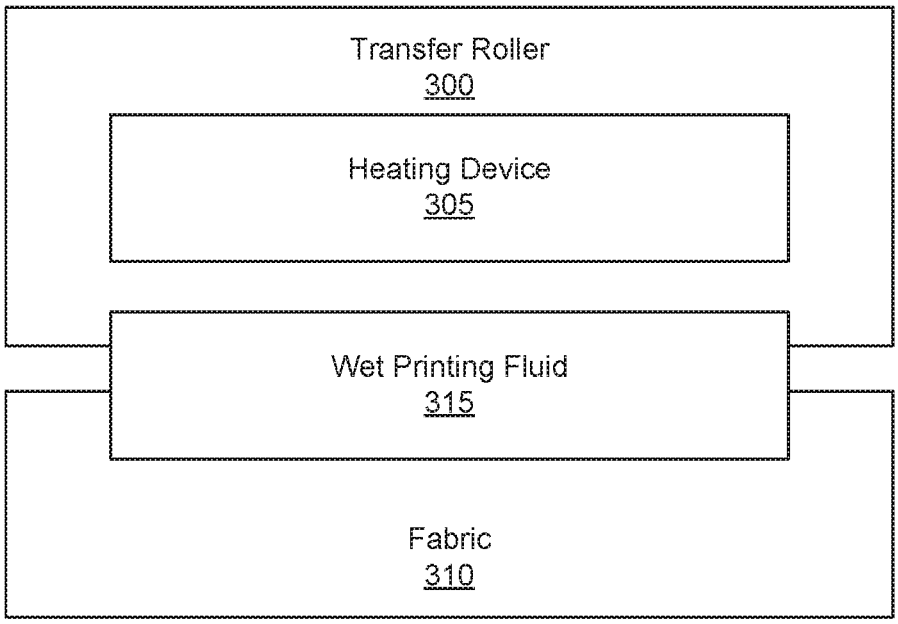
FIG. 3 is a block diagram of a transfer roller according to an example of the principles described herein.

FIG. 3 is a block diagram of a transfer roller (300) according to an example of the principles described herein. The transfer roller (300) may include at least one heating device (305) that heats the transfer roller (300) prior to application of a wet printing fluid (315) to a fabric (310). As described herein, the wet printing fluid (315) includes a significant portion of its original carrier fluid therein. This percentage of carrier fluid remaining in the wet printing fluid (315) allows the wet printing fluid (315) to be absorbed or otherwise incorporated into the fibers of the fabric (310). The temperature of the transfer roller (300) may be kept at between 70° to 95° Celsius by the heating device (305) so as to prevent a percentage of carrier fluid from evaporating above 0 to 10 percent.

Figure 4:
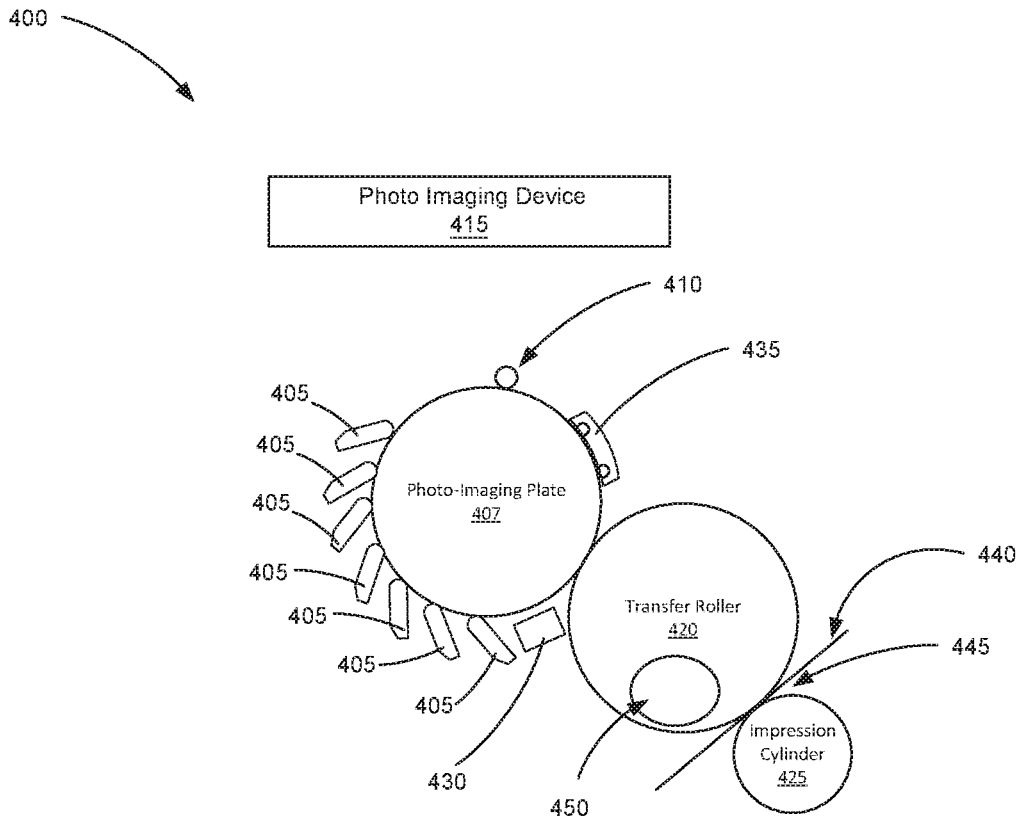
FIG. 4 is a diagram of a liquid electrophotographic (LEP) printing device according to an example of the principles described herein.

FIG. 4 is a diagram of a liquid electrophotographic (LEP) printing device (400) according to an example of the principles described herein. As described above, FIG. 4 shows a layout of a number of printing fluid developers (405) oriented around a PIP (407). Each of the printing fluid developers (405) may be oriented differently around to the PIP (407) such that the orientation of each of the printing fluid developers (405) may vary from vertical to horizontal.

Along with the other elements described in connection with the printing fluid developers (405), the system (400) may further include the PIP (407), a charging device (410), a photo imaging device (415), a transfer roller (420), an impression cylinder (525), a discharging device (530), and a cleaning station (435). The printing fluid developers (405) are disposed adjacent to the PIP (407) and may correspond to various colors such as cyan, magenta, yellow, black, and the like. The charging device (410) applies an electrostatic charge to a photoconductive surface such as the outer surface of the PIP (407). A photo imaging device (415) such as a laser exposes selected areas on the PIP (407) to light in a pattern of the desired printed image to dissipate the charge on the selected areas of PIP (407) exposed to the light.

For example, the discharged areas on PIP (407) form an electrostatic image which corresponds to the image to be printed. A thin layer of printing fluid is applied to the patterned PIP (407) using the various printing fluid developers (405) to form the latent image thereon. The printing fluid adheres to the discharged areas of PIP (407) in a layer of printing fluid on the PIP (407) and develops the latent electrostatic image into a toner image, the toner image is transferred from the photoconductive member (505) to the transfer roller (420). Subsequently, the toner image is transferred from the transfer roller (420) to the fabric (440) as the fabric (440) passes through an impression nip (445) formed between the transfer roller (420) and the impression cylinder (425). The discharging device (430) removes residual charge from the photoconductive member (407). The cleaning station (435) removes toner residue in preparation of developing the new image or applying the next toner color plane.

A heating element (450) may also be associated with the transfer roller (420) in order to heat the transfer roller (420) to between 70° and 95° Celsius. As described above, this level of heat does not cause a significant portion of the carrier fluid within the printing fluid from evaporating causing the printing fluid to be applied to the fabric (440) wet. This causes the printing fluid to be embedded into the fibers of the fabric (440) thereby causing the image to remain with the fabric (440) after drying.

Aspects of the present system and method are described herein with reference to flowchart illustrations and/or block diagrams of methods, apparatus (systems) and computer program products according to examples of the principles described herein. Each block of the flowchart illustrations and block diagrams, and combinations of blocks in the flowchart illustrations and block diagrams, may be implemented by computer usable program code. The computer usable program code may be provided to a processor of a general-purpose computer, special purpose computer, or other programmable data processing apparatus to produce a machine, such that the computer usable program code, when executed via, for example, the processor of the LEP printing device or other programmable data processing apparatus, implement the functions or acts specified in the flowchart and/or block diagram block or blocks. In one example, the computer usable program code may be embodied within a computer readable storage medium; the computer readable storage medium being part of the computer program product. In one example, the computer readable storage medium is a non-transitory computer readable medium.

The specification and figures describe a LEP printing device that prints an image onto a fabric substrate using a transfer roller that is heated to about 70° to 95° Celsius. The lowered temperature reduces the amount of carrier fluid in the printing fluid from evaporating allowing the printing fluid and especially the pigments of the printing fluid to be embedded into the fibers of the fabric substrate. This reduces or eliminates any flaking or peeling of the subsequently dried printing fluid from off the fabric substrate. Additionally, the reduction and/or increase of the temperature of the transfer roller allows for the LEP to be selectively used for paper substrates or fabric substrates. Additionally, because the printing fluid is imbedded into the fibers of the fabric, there is no hardening of the image on the surface of the fabric substrate causing relatively more flexibility in the fabric. Further, the process and devices described herein eliminates the use of pre-transfer media to affix an image to the fabric substrate thereby saving costs.

The preceding description has been presented to illustrate and describe examples of the principles described. This description is not intended to be exhaustive or to limit these principles to any precise form disclosed. Many modifications and variations are possible in light of the above teaching.

What is claimed is:

1. A liquid electrophotographic (LEP) printing device comprising:

a photo-imaging plate (PIP) to receive a liquid printing fluid, the liquid printing fluid comprising:
- a pigment incorporated into a resin;
- a charge conductor; and
- a carrier liquid; and a transfer roller to transfer wet liquid printing fluid from the PIP to a fabric substrate while preventing evaporation of the carrier liquid, such that at most 10% of the carrier liquid is evaporated on the transfer roller before transfer of the liquid printing fluid to the fabric substrate.

2. The LEP printing device of claim 1, wherein the transfer roller is heated to a temperature of 70° to 95° Celsius to prevent evaporation of the carrier liquid.

3. The LEP printing device of claim 1, wherein the carrier liquid is an isoparaffinic hydrocarbon and wherein a portion of the isoparaffinic hydrocarbon is not evaporated during transfer of the printing fluid onto the fabric.

4. The LEP printing device of claim 1, further comprising a heating device associated with the transfer roller and a temperature controller, wherein the temperature controller adjusts the temperature of the transfer roller to at least two different temperatures based on whether a paper printing substrate is to be printed on or the fabric substrate is to be printed on.

5. A system for printing onto fabric, the system comprising:

a printing fluid source comprising a printing fluid, the printing fluid comprising, at least, a carrier fluid; and a heat adjustable transfer roller to:
- receive an amount of printing fluid from a photo imaging plate;
- transfer the printing fluid as a wet printing fluid to the fabric while preventing the carrier fluid from evaporating such that at most 10% of the carrier liquid is evaporated on the transfer roller before transfer of the liquid printing fluid to the fabric substrate; and
- a processor to, based on received input, determine a temperature to heat the transfer roller to during printing.

6. The system of claim 5, wherein the processor is to determine the amount of carrier fluid to evaporate based on a fabric type.

7. The system of claim 5, wherein the printing fluid further comprises a pigment incorporated into a resin and a charge conductor.

8. The system of claim 5, wherein the carrier fluid is an isoparaffinic hydrocarbon and wherein a portion of the isoparaffinic hydrocarbon is not evaporated during transfer of the printing fluid onto the fabric.

9. The system of claim 5, wherein the heat adjustable transfer roller is heated to a temperature of 70° to 95° Celsius.

10. The system of claim 5, wherein the processor is to determine the amount of carrier to evaporate based on a porousness and an absorbability of the fabric substrate.

11. A method, comprising:

receiving a wet printing fluid at a photo-imaging plate, the wet printing fluid comprising a level of carrier fluid to be absorbed into fibers of a fabric substrate;

transferring the wet printing fluid to a transfer roller; and during printing, preventing evaporation of the carrier fluid such that at most 10% of the carrier fluid is evaporated on the transfer roller before transfer of the wet printing fluid to the fabric substrate.

12. The method of claim 11, further comprising evaporating the carrier fluid following printing.

13. The method of claim 11, further comprising accumulating an amount of printed fabric substrate.

14. The method of claim 13, further comprising evaporating the carrier fluid following accumulation.

15. The method of claim 11, further comprising, determining an amount of carrier fluid to evaporate based on a property of the fabric substrate.

16. The method of claim 15, wherein the property is selected from the group consisting of:

a porousness of the fabric substrate;

a type of material of the fabric substrate;

an absorbability of the fabric substrate; or a combination thereof.

17. The method of claim 11, further comprising, determining heat for the transfer roller based on a property of the fabric substrate.

* * * * *